US008839571B1

(12) United States Patent
Atchley et al.

(10) Patent No.: US 8,839,571 B1
(45) Date of Patent: Sep. 23, 2014

(54) BREAK-AWAY SCREW GROUND ANCHOR

(71) Applicant: Hubbell Incorporated, Shelton, CT (US)

(72) Inventors: Jacob C. Atchley, Columbia, MO (US); Daniel V. Hamilton, Centralia, MO (US); Kelly S. Hawkins, Centralia, MO (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 13/804,771

(22) Filed: Mar. 14, 2013

(51) Int. Cl.
*E02D 5/80* (2006.01)

(52) U.S. Cl.
CPC ..... *E02D 5/805* (2013.01); *E02D 5/801* (2013.01)
USPC ..... 52/157

(58) Field of Classification Search
CPC ..... E02D 5/56; E02D 5/801; E02D 5/805; E02D 7/22; E04H 12/2223
USPC ..... 52/155, 156, 157, 158, 160; 405/253, 405/252.1, 259.2; 411/386, 387.1
See application file for complete search history.

(56) References Cited

U.S. PATENT DOCUMENTS

| | | | | | |
|---|---|---|---|---|---|
| 108,814 | A | * | 11/1870 | Moseley | 405/222 |
| 137,744 | A | | 4/1873 | West | |
| 269,548 | A | | 12/1882 | Stephenson | |
| 444,956 | A | * | 1/1891 | Jones | 408/200 |
| 778,845 | A | * | 1/1905 | Cox | 408/214 |
| 1,270,092 | A | | 6/1918 | Armstrong | |
| 3,043,383 | A | | 7/1962 | Newbold | |
| 3,148,739 | A | | 9/1964 | Mattingly et al. | |
| 3,444,940 | A | | 5/1969 | Thomas et al. | |
| 3,916,757 | A | * | 11/1975 | Wilson | 411/386 |
| 3,962,879 | A | * | 6/1976 | Turzillo | 405/236 |
| 4,054,045 | A | * | 10/1977 | King, Jr. | 72/40 |
| 4,334,392 | A | | 6/1982 | Dziedzic | |
| 4,467,575 | A | | 8/1984 | Dziedzic | |
| 4,536,107 | A | * | 8/1985 | Sandy et al. | 408/214 |
| 4,617,692 | A | | 10/1986 | Bond et al. | |
| 4,750,571 | A | | 6/1988 | Geeting | |
| 4,793,740 | A | | 12/1988 | Schellhorn | |
| 4,898,252 | A | | 2/1990 | Barr | |
| 4,958,972 | A | * | 9/1990 | Shinjo | 411/387.1 |
| 4,979,341 | A | | 12/1990 | Norman et al. | |

(Continued)

OTHER PUBLICATIONS

International Search Report and Written Opinion, dated Jun. 13, 2014, for PCT/US14/18374.

*Primary Examiner* — Christine T Cajilig
(74) *Attorney, Agent, or Firm* — Garrett V. Davis; Mark S. Bicks; Alfred N. Goodman

(57) ABSTRACT

A ground anchor is provided for driving into the ground for anchoring or supporting a structure. The ground anchor includes a hub with a helical load bearing screw and a pointed ground engaging end. The ground engaging end has a blade extending axially from the hub with first and second opposing major faces and first and second transverse faces that converge at the axial end to a flat axial face. The blade has one or more diagonal frangible portions to define a diagonal break line. The breakable portion of the ground anchor penetrates the ground and breaks away from the blade when a predetermined torque or stress is applied to the blade. The breakable portion breaks away to form a ground engaging end having a dimension and surface area that is larger than the original ground engaging end.

26 Claims, 8 Drawing Sheets

(56) References Cited

U.S. PATENT DOCUMENTS

| | | | | | |
|---|---|---|---|---|---|
| 4,981,000 | A | | 1/1991 | Hamilton et al. | |
| 5,145,286 | A | | 9/1992 | Summers | |
| 5,244,319 | A | * | 9/1993 | Cochran | 408/211 |
| 5,286,142 | A | | 2/1994 | Hoyt et al. | |
| 5,372,466 | A | * | 12/1994 | O'Berry | 411/411 |
| 5,408,788 | A | | 4/1995 | Hamilton et al. | |
| 5,575,122 | A | | 11/1996 | Hamilton et al. | |
| 5,625,994 | A | * | 5/1997 | Giannuzzi | 52/705 |
| 5,899,123 | A | | 5/1999 | Lukes | |
| 6,352,391 | B1 | * | 3/2002 | Jones | 405/252.1 |
| 6,394,704 | B1 | | 5/2002 | Saeki et al. | |
| 6,494,643 | B1 | | 12/2002 | Thurner | |
| 6,588,515 | B2 | | 7/2003 | Wentworth et al. | |
| 7,182,556 | B2 | | 2/2007 | Takiguchi et al. | |
| 7,377,723 | B2 | | 5/2008 | Nolan | |
| 8,109,700 | B2 | | 2/2012 | Jordan et al. | |
| 8,137,042 | B2 | * | 3/2012 | Severns | 411/387.1 |
| 2011/0229272 | A1 | * | 9/2011 | Lindsay et al. | 405/253 |
| 2012/0195691 | A1 | | 8/2012 | Dolly et al. | |
| 2012/0205161 | A1 | | 8/2012 | Stimpfle-Ziegler | |

* cited by examiner

BREAK-AWAY SCREW GROUND ANCHOR

FIELD OF THE INVENTION

The present invention is directed to a ground anchor and to a method of driving a ground anchor into the ground. The invention is particularly directed to a ground anchor having a breakable tip to assist in driving the ground anchor into soils having different densities.

BACKGROUND OF THE INVENTION

Ground anchors are commonly used to support various structures and for use by utilities for anchoring supports, utility poles, and the like. The anchors often have an elongated shaft with a square or round cross-section. A top end of the shaft has a drive connection for coupling to a rotating drive assembly. The bottom, ground engaging end has one or more helical outwardly extending load bearing plates fixed to a hub.

One examples of a screw anchor is disclosed in U.S. Pat. No. 4,334,392 to Dziedzic. This device is a modular screw anchor having an elongated rod with one or more specialized anchor members. The shaft also includes an obliquely oriented beveled earth penetrating lead to facilitate installation in rock soils. The anchor has a tubular, rod-receiving hub having a polygonal cross-section. An outwardly extending helical blade is fixed to the hub.

U.S. Pat. No. 5,408,788 to Hamilton et al. discloses a screw anchor having a hollow hub for receiving a wrench. A helical, load bearing element projects outwardly from the hub. An elongated, pointed spade extends from the end away from the hub. The spade has two diametrically opposed angular cutting margins on opposite sides of the hub.

One example of a prior device is disclosed in U.S. Pat. No. 4,617,692 to Bond et al. which discloses a drilling tip and expansion anchor for drilling a hole in a wall. The threaded shaft is rotated in a first direction to expand the anchor with a drill tip attached to the end of the shaft. The shaft is then rotated in the opposite direction to unscrew the shaft from the tip.

U.S. Pat. No. 4,750,571 to Geeting discloses a drilling apparatus having a disposable tip. A disposable cutting tip is attached to the auger section which is positioned within the ground screen. The tip is attached to the auger by a shear pin or bolt. The shear pin breaks when the auger is removed from the ground thereby leaving the drill tip in the ground.

U.S. Pat. No. 4,898,252 to Barr discloses a cutting tip for a rotary drill bit. The drill bit includes a wear surface attached to a plurality of plates forming the carrier for the cutting element. As the cutting edge wears, the plates break away to increase the clearance of the rear portion of the cutting edge and reducing the size of the wear surface to reduce the resistance to drilling.

U.S. Pat. No. 5,899,123 to Lukes discloses a threaded fastener having a drill point connected to the threaded fastener by a frangible line. The drill tip drills a hole through the work piece until the drill tip engages an inclined surface thereby causing the drill tip to break away from the threaded fastener.

U.S. Pat. No. 6,588,515 to Wentworth et al. discloses a rock drilling bit with a plurality of cutting teeth raked into the cut of the drilling bit. The teeth are angled at about 30° to provide the shear cutting force. The arrangement of the teeth reduces shock and vibration applied to the housing.

U.S. Pat. No. 7,182,556 to Takiguchi et al. discloses a drill with a disposable insert tip. The drill has a drill main body and an insert that is attached to the main body. The end of the main body has a plurality of guiding grooves shown in FIG. 2. The removable tip has convex portions that engage the guiding grooves. The drill does not have a frangible or break away portion.

U.S. Pat. No. 8,109,700 to Jordan et al. discloses a replaceable tip for a bit or auger. As shown in FIG. 1, the replaceable tip has a threaded shaft that is threaded into the threaded bore in the shaft of the auger. In the embodiment shown in FIG. 5, the auger has an end portion that is removably coupled to the shaft of the auger. The tip of the auger does not include a frangible portion.

While these prior devices have generally been suitable for their intended purpose, there is a continuing need in the industry for improved ground anchors.

SUMMARY OF THE INVENTION

The present invention is directed to a screw ground anchor and assembly for driving the ground anchor into the ground. The invention is particularly directed to a screw ground anchor having a breakable tip that breaks under stress while penetrating the ground to form a blunt angled tip adapted for penetrating dense soil and rock.

The ground anchor of the invention has a ground engaging end forming a pointed tip that is able to stabilize the anchor and to penetrate the ground by a drive assembly in softer soils. The ground engaging end with the pointed tip has angled faces that are able to penetrate the ground in various soil and rock conditions. The ground anchor also includes a hub with a helical load bearing screw for supporting a load and/or anchoring cables or other structures.

Accordingly, one aspect of the invention is to provide a ground anchor and screw that is able to penetrate the ground to support a load or anchor a structure where the ground anchor can be used in hard and soft soils without the need to replace the tip during use and installation when different soil and rock conditions exist.

The invention is also directed to a ground anchor that can be used with conventional driving apparatus without the need to modify the existing drive or drilling apparatus.

Another feature of the invention is to provide a ground anchor having a blade with a tip that can be used in softer soils at the surface and is also able to efficiently penetrate the harder subsoil without the need to replace the drilling tip or to remove the assembly from the ground to change the assembly or anchoring members.

The screw ground anchor assembly of the invention has a hub with a load bearing helical screw and a ground engaging end that is able to penetrate the ground to drive the load bearing screw into the ground to a depth necessary to support the desired load or anchor the intended structure.

The screw ground anchor of the invention has a blade extending axially from the assembly where the blade has side faces that converge to a pointed tip. The pointed tip can have a blunt, flat surface extending substantially perpendicular to a longitudinal axis of the anchor. The blade has two opposing major faces that converge toward the tip and two minor faces that also converge toward the tip. In one embodiment of the invention, the blade has a frangible end portion at the distal end that can break away under a predetermined torque and stress produced by the driving assembly as the blade penetrates the ground. The frangible end portion is able to provide an axial end face with a larger ground engaging surface area with an angled face that is able to penetrate harder soils and rock compared to the smaller pointed tip. The ground engaging axial surface formed by the frangible end portion has an angled face extending at an incline with respect to the longitudinal axis of the anchor.

The side faces of the blade can have a frangible portion formed therein that is able to break under the torque produced by the drive assembly and the resistance to the ground to expose and form the new ground engaging end. The frangible portion allows the end portion to break away when harder soils are contacted during the installation of the ground anchor without the need to remove the ground anchor from the ground or assembly from the ground when hard soils are encountered. The ground anchor is able to drill past and around the broken separated end so that it is not necessary to remove the broken end from the ground. The broken end of the ground anchor can be left in the ground along with the remaining debris.

At least one of the side faces of the blade can have a groove formed therein extending across the face to define the frangible portion and breakable end portion. In one embodiment, the blade has the two opposing major surfaces each formed with a groove to define a frangible line extending between the grooves that can break under a predetermined load or torque to expose a new surface for penetrating the ground, thereby enabling the ground anchor to continue penetrating the ground. In one embodiment, the groove extends transversely across the blade along a plane perpendicular to a center axis of the ground anchor. In another embodiment, the groove can extend across the blade along a line that is oriented diagonally with respect to the longitudinal axis of the ground anchor.

The ground anchor in another embodiment can have a serrated edge formed at the groove forming the frangible portion to expose serrated teeth when the breakable end portion separates from the blade.

These and other aspects of the invention are basically attained by providing a ground anchor comprising a shaft adapted for coupling to a drive assembly to rotate the ground anchor. A body portion is integrally formed with the shaft, The body has a dimension greater than the shaft. The body has a top side coupled to the shaft and a ground engaging bottom side. A blade projects downwardly from the bottom side of the body portion. The blade has first and second major faces converging to an axial face at a distal end of the blade from a first cutting edge. First and second minor faces extend between the major faces and converge toward the axial face at the distal end. The blade has a frangible portion for breaking an end portion of the blade from the ground anchor to form a second cutting edge.

The various features and advantages of the invention are also attained by providing a ground anchor adapted for driving into the ground. The ground anchor comprises a hub having a radially extending, helical load bearing member. The load bearing member extends outward from the hub and has a leading edge and a trailing edge. A body portion with a top side is coupled to a bottom end of the hub and a bottom side facing away from the hub in an axial direction with respect to the hub. A blade projects axially downward from the bottom side of the body portion. The blade has first and second major faces and first and second minor faces extending between the major faces. Each of the major and minor faces converge to a distal end having a first axial face. The blade has a frangible portion to break an end portion from the blade to expose a ground engaging second axial face having a dimension and surface area greater than the first axial face.

The objects and advantages of the invention are further attained by providing a method of anchoring a structure to the ground. The method comprises driving a ground anchor into the ground to a first depth. The ground anchor has a hub with a radially extending helical load bearing member. The load bearing member extends outward from the hub and has a leading edge and trailing edge. A body portion with a top side is coupled to a bottom end of the hub and an axially facing bottom side faces away from the hub. A blade projects from the bottom side of the body portion. The blade has first and second major faces and first and second minor faces extending between the major faces. Each of the major and minor faces converge to a distal end having a substantially blunt axial face with a first dimension. The method further comprises driving the ground anchor into the ground to a second depth whereby a breakable end portion of the blade breaks free of the tip to expose a second blunt axial face having a second dimension greater than the first dimension without removing the ground anchor or broken end portion from the ground. The structure is then coupled to the ground anchor.

The various objects, advantages and salient features of the invention will become apparent from the annexed drawings and detailed description of the invention which form part of the original disclosure.

BRIEF DESCRIPTION OF THE DRAWINGS

The following is a brief description of the drawings, in which.

DETAILED DESCRIPTION OF THE INVENTION

Figure 1:
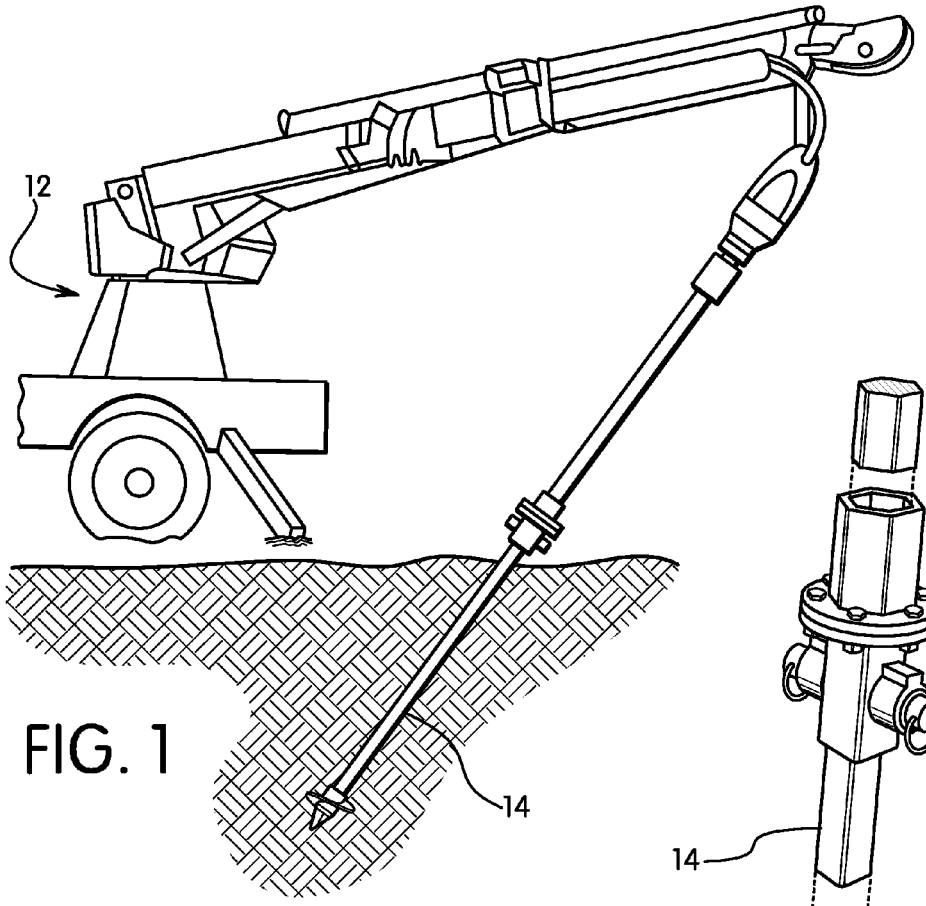
FIG. 1 is a side view of the ground anchor during installation into the ground.
Figure 2:
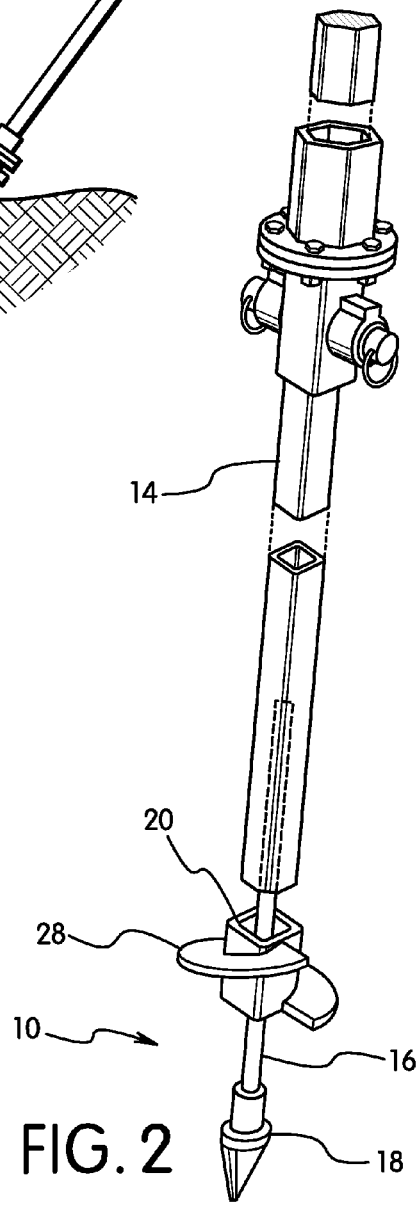
FIG. 2 is an exploded view of the ground anchor and installation assembly in one embodiment of the invention.

The present invention is directed to a screw ground anchor for penetrating the ground for anchoring or supporting a structure. As shown in FIGS. 1 and 2, the ground anchor 10 is driven into the ground to a selected depth using a commercially available drilling apparatus 12. The drilling apparatus in the embodiment shown includes a drive member 14 having a square cross-section for mating with the ground anchor 10.

Once the ground anchor is driven into the ground, the drive member 14 is removed. An anchoring rod 16 is coupled to the ground anchor and is connected to a guy wire for anchoring the intended structure. Examples of drilling apparatus and anchoring assemblies are disclosed in U.S. Pat. Nos. 4,334,392, 5,408,788 and 5,575,122, which are hereby incorporated by reference in their entirety.

Figure 3:
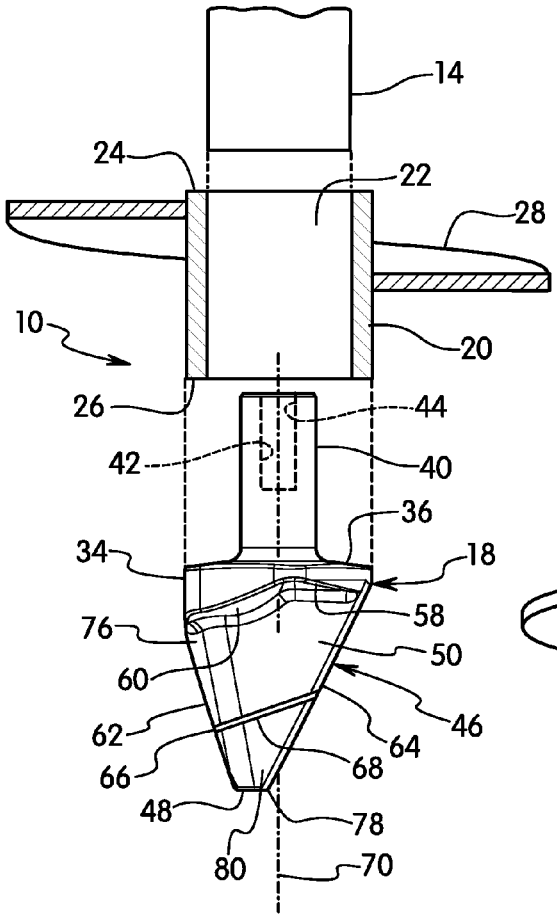
FIG. 3 is an exploded view of the ground anchor showing the screw tip and hub.
Figure 4:
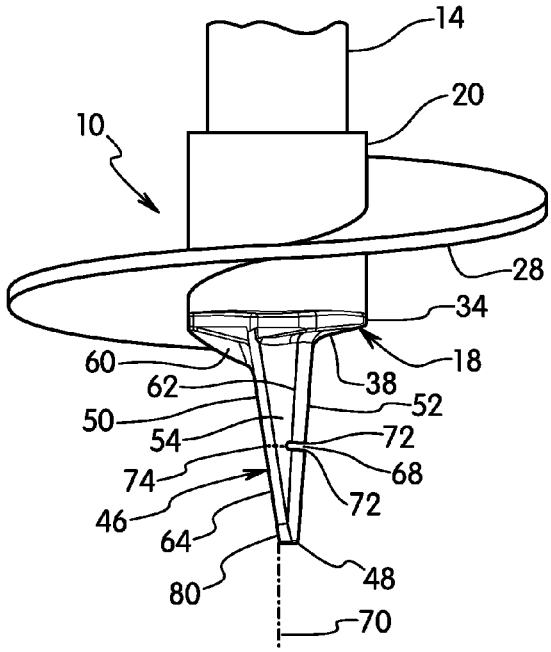
FIG. 4 is a front view of the screw ground anchor in a first embodiment.
Figure 5:
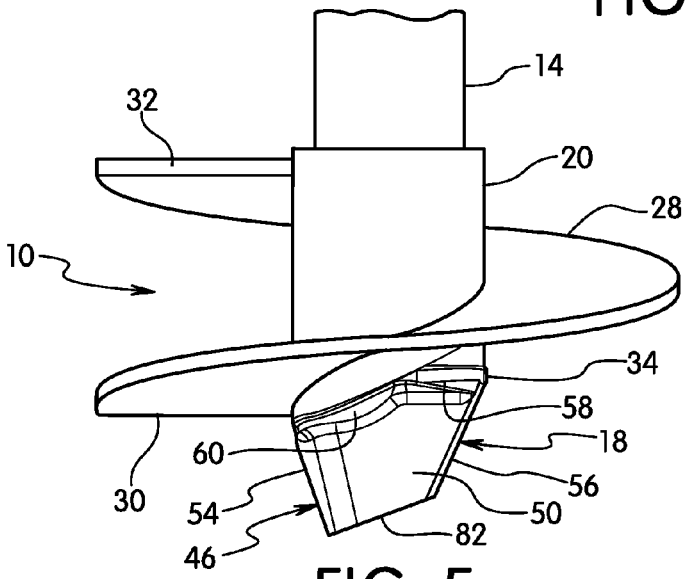
FIG. 5 is a side view of the screw ground anchor showing the tip section removed.
Figure 7:
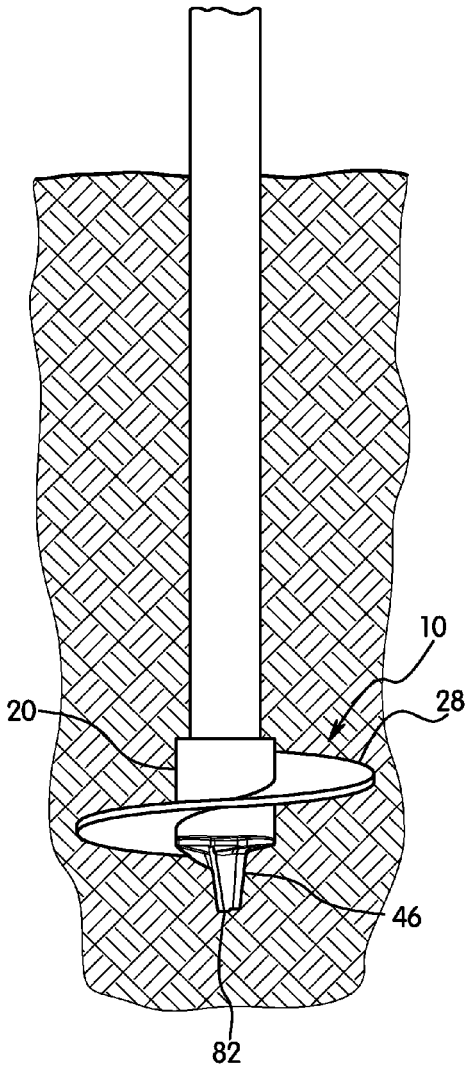
FIG. 7 is a side view of the screw ground anchor during installation after the tip section separates.
Figure 8:
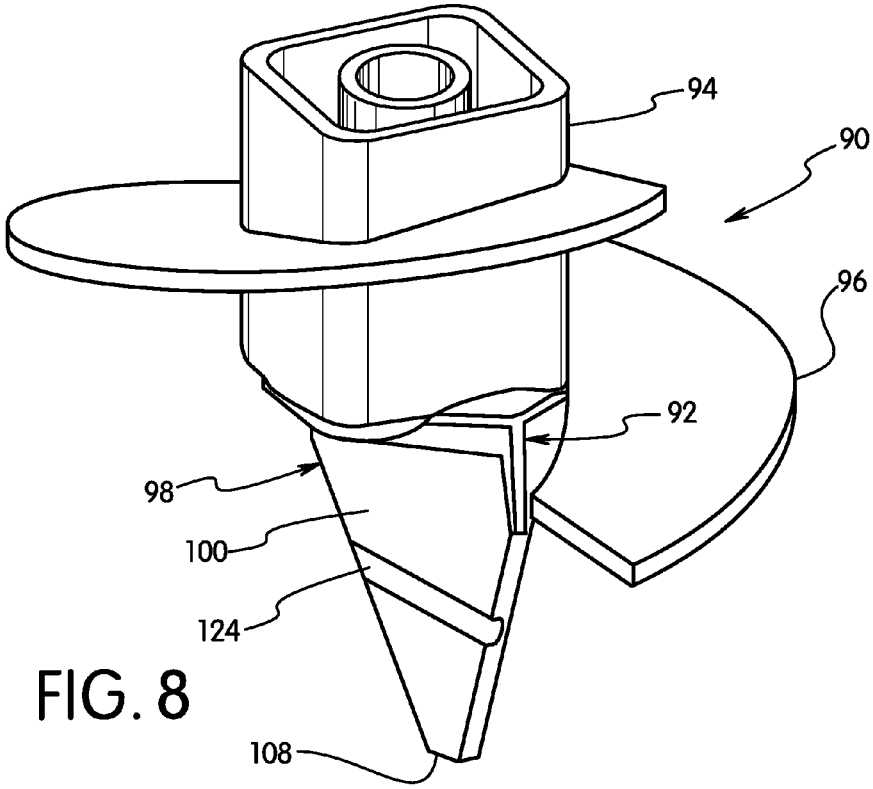
FIG. 8 is a perspective view of the screw ground anchor.

Referring to FIGS. 3-15, the ground anchor 10 includes a ground engaging lead 18 and a hub 20. The lead 18 and hub are coupled together as shown in FIGS. 4 and 5 by welding. The hub 20 as shown in FIG. 8 has a substantially square cross-section with a hollow interior for receiving the drive member 14. The hub 20 has a top end 24 for mating with the drive member 14 and a bottom end 26 coupled to the ground engaging lead 18. As shown in FIGS. 3 and 4, a helical screw 28 is fixed to the outer face of the hub 20 for penetrating the ground and anchoring and/or supporting the structure. The helical screw 28 has a dimension sufficient to anchor the desired structure. In one embodiment, the helical screw has a leading edge 30 that is coupled to a portion of the ground engaging lead 18 and a trailing edge 32 towards the top end 24 of the hub 20.

The ground engaging lead 18 of the ground anchor 10 has a body portion 34 with a top face 36 and bottom face 38. The top face 36 of body portion 34 includes a shaft 40 extending axially in an upward direction. The shaft 40 has a substantially cylindrical shape with an axial bore 42 as shown in FIG. 8. The axial bore 42 is typically provided with internal threads 44 for mating with the anchor rod 16. As shown in FIGS. 3 and 4, the body portion has an outer dimension corresponding substantially to the dimension of the hub 20 and is coupled to the hub 20 by suitable means such as welding.

A ground engaging blade 46 extends axially from the bottom face 38 of the body 34. As shown in the drawings, blade 46 has tapered sides that converge to an axial end face 48 at a distal end of the blade 46. Blade 46 has a first major face 50 and a second opposing major face 52 that converge toward the axial end 48 and a first minor face 54 and a second minor face 56 that converge to the axial end 48. The axial end face 48 typically has a flat surface lying in a plane perpendicular to the longitudinal axis of the anchor and blade for forming a cutting edge.

The body 34 has an enlarged area with an outwardly facing surface 58 extending axially downward from the hub 20. The bottom surface of the body 34 in the area of the enlarged portion forms an inclined surface 60 that extends from the first minor face to the second minor face as shown in FIG. 5. The outer surface 58 forms a support surface for the leading edge of the helical screw 28.

The blade 46 has a substantially trapezoidal shaped cross-section. The first major face 50 and second major face 52 are inclined with respect to each other and the first minor face 54 and second minor face 56 are inclined with respect to each other. The first and second minor faces are also formed at an incline with respect to the first and second major faces. The trapezoidal shaped blade forms a first cutting edge 62 formed between the first major face 50 and first minor face 54, and a second cutting edge 64 formed between the second major face 52 and the second minor face 56.

Referring to FIGS. 3 and 4, the blade 46 has a frangible portion 66 formed by a groove 68 in the first major face 50. The groove 68 has a longitudinal dimension extending diagonally with respect to the longitudinal center axis 70 of the ground anchor 10. In the embodiment shown, the groove 68 is formed by two parallel opposing surfaces 72 to form a break line 74 extending across the blade 46.

In the embodiment shown, the axial end face 48 of the blade 46 has a substantially flat surface extending perpendicular to the center axis 70 to form a blunt end. As shown in FIGS. 3 and 4, the blade 46 is oriented on the body portion 34 such that the base portion 76 is positioned in the center of the body portion 34. The axial end face 48 is off-center from the center axis 70 such that the innermost edge 78 of the blade 46 is aligned with the center axis 70 or slightly outside the center axis such that the axial end face 48 rotates about the center axis in a circular path during rotation of the ground anchor 10. The axial end 48 has a surface area and dimension that is able to penetrate the soil during the initial phase of the installation of the ground anchor in the ground and allow the blade 46 to penetrate the ground to prevent the ground anchor from moving or walking from the intended penetration site until the ground anchor is able to penetrate the ground.

Figure 6:
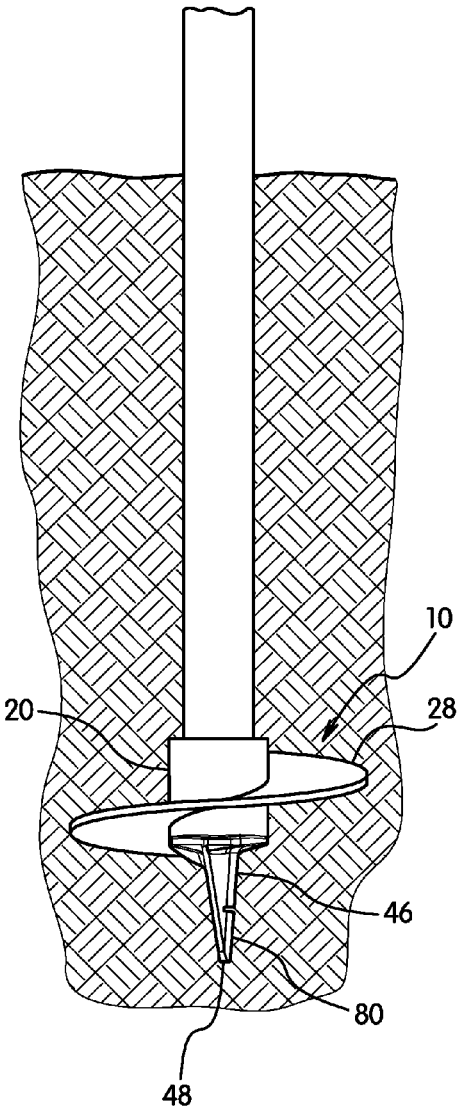
FIG. 6 is a side view of the screw ground anchor during installation in the ground.

The groove 68 in the blade 46 forms a frangible break line 74 that causes the end portion 80 to break away from the blade 46 when the ground anchor contacts hard soil or rock. The end portion 80 breaks away to from an end face 82 that has a surface area larger than the axial end face 48 where the end face 82 is formed at an incline with respect to the center axis 70 as shown in FIG. 5. The end face 82 defines a cutting edge of the anchor. As shown in FIGS. 6 and 7, the ground anchor 10 is driven into the ground by a suitable drive assembly. As the depth of the ground anchor increases and harder soil and rock are contacted, the torque and stress on the end portion 80 causes the end portion 80 to break away from the blade to expose the end face 82. The larger surface area and angled face of the end face 82 enables the ground anchor to penetrate hard and rocky soils more easily than the pointed blade with the smaller surface area of the axial end 48. The broken end portion 80 remains in the ground as the ground anchor 10 penetrates deeper into the ground to the selected depth.

In a second embodiment of the invention shown in FIGS. 8-15, the ground anchor 90 is similar to the embodiment of FIGS. 1-7. The ground anchor 90 includes a ground engaging lead 92 coupled to a hub 94 with a helical ground engaging screw 94. The shape and dimensions of the ground engaging lead, hub and screw are substantially the same as in the embodiment of FIGS. 1-7.

In the embodiment shown, the ground engaging lead 92 includes a blade 98 having a first major face 100, and an opposing second major face 102. A first minor face 104 and second minor face 106 extend between the first major face 100 and the second major face 102 to define the blade 98 with a substantially trapezoidal shaped cross-section as in the previous embodiment. Each of the major faces 100 and 102 and each of the minor faces 104 and 106 converge to form a pointed axial end 108 to form a ground engaging tip. The axial end 108 has a substantially flat surface formed in a plane substantially perpendicular to the longitudinal axis 110 of the ground engaging anchor 90. As in the previous embodiment, the axial end 108 is off-center from the longitudinal axis 110 such that the axial end rotates in a circular path adjacent to or outside the longitudinal axis 110.

Figure 9:
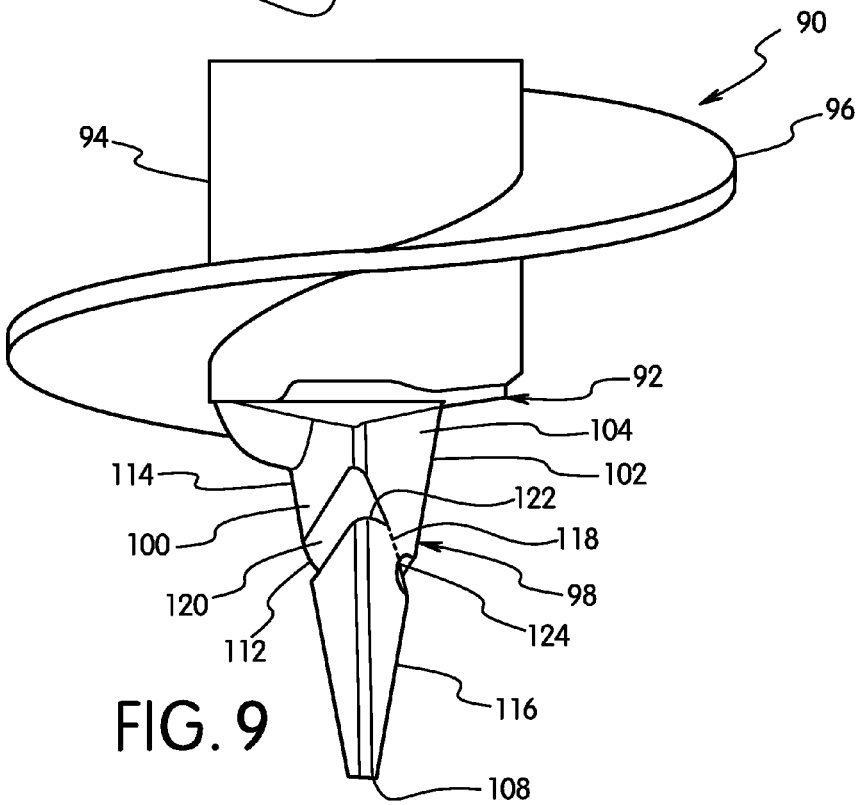
FIG. 9 is a front view of the screw ground anchor.
Figure 10:
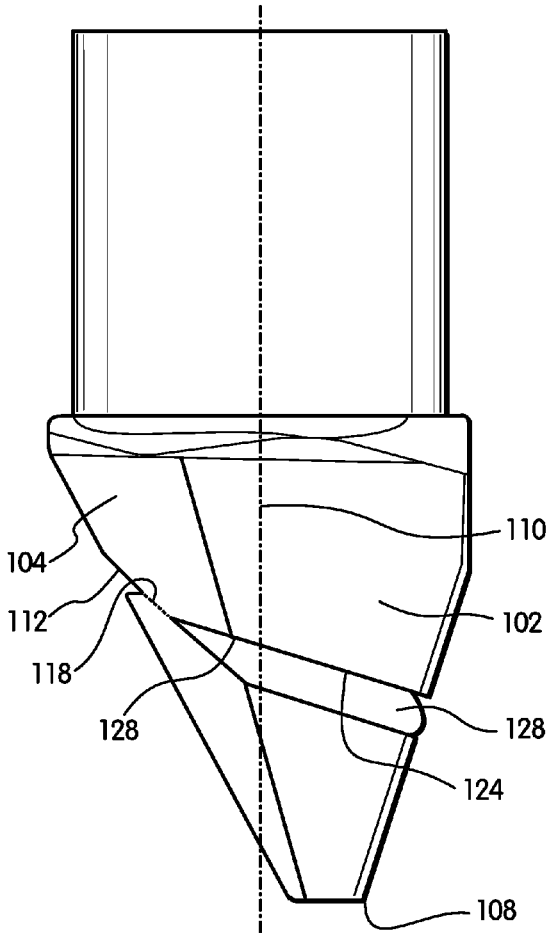
FIG. 10 is a side view of the screw ground anchor.
Figure 11:
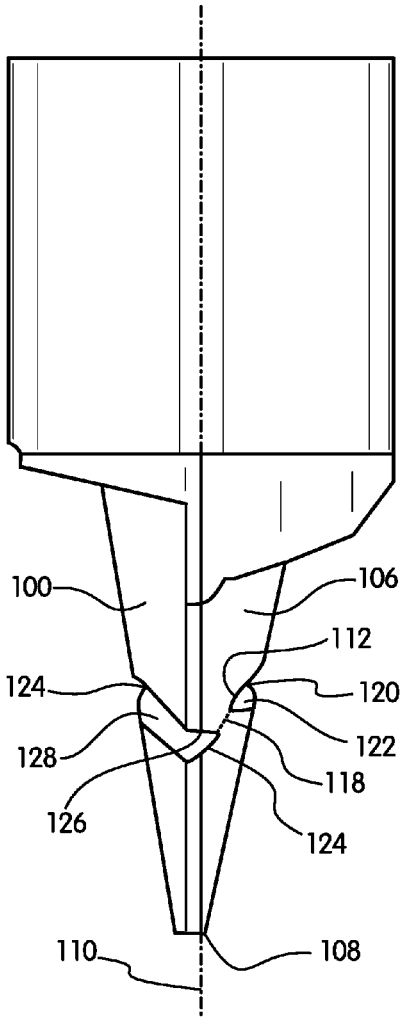
FIG. 11 is a rear view of the screw ground anchor.
Figure 12:
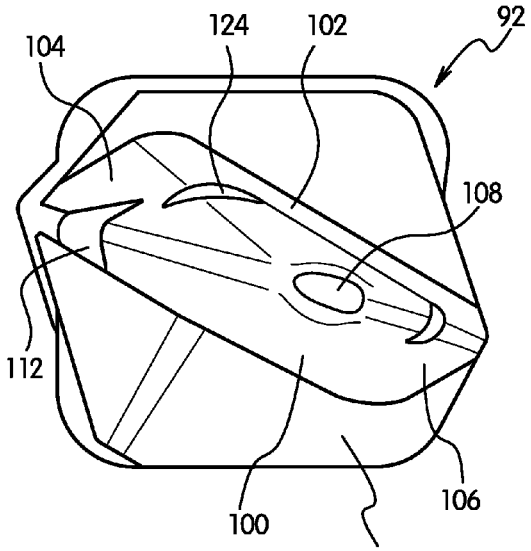
FIG. 12 is an end view of the screw ground anchor.

Referring to FIG. 9, the first major face 100 includes a first longitudinal groove 112 having a substantially V-shape extending diagonally across the first major face 100 with respect to the longitudinal axis 110. The groove 112 divides the blade 98 into an upper portion 114 and a breakable end portion 116 along a frangible break line 118. The first groove 112 is formed by an upper face 120 having a longitudinal dimension extending across the width of the blade 98 and a transverse dimension extending at an inclined angle towards the distal end of the blade 98 and at an incline with respect to the longitudinal axis 110. The first groove 112 is also formed by a lower face 122 having a transverse dimension extending substantially perpendicular to the longitudinal axis 110 and intersecting the upper face 120. The first groove 112 extends along the first major face 100 between the first minor face 104 and the second minor face 106.

The second major face 102 includes a second groove 124 that is axially spaced from the first groove 112 towards the axial end 108 and substantially parallel to the first groove 112. As shown in FIG. 9, the second groove 124 is formed by a first upper face 126 and a second lower face 128 to form a substantially V-shaped groove. The first upper face 126 lies in a plane substantially parallel to the second lower face 122 of the first groove 112 and is axially spaced from the lower face 122 towards the axial end 108 with the break line 118 extending between them. The second lower face 128 of the second groove 124 extends at an inclined angle with respect to the first upper face 126. The second lower face 128 has a longitudinal dimension extending diagonally across the second major face 102 and has a transverse dimension formed at an incline with respect to the longitudinal axis 110. In the embodiment shown, the second lower face 128 lies in a plane substantially parallel to the first upper face 20 of the first groove 112 to form the break line 118 substantially lying in the plane of the first upper face 120 and the second lower face 128.

During use, the ground anchor 90 is connected to a rotary drive assembly as in the previous embodiment and driven into the ground by the rotational driving force of the drive apparatus. The blunt axial end 108 initially penetrates the soil at the surface for driving the ground anchor 90 into the ground. As the ground anchor 90 is driven to greater depths, the stress on the breakable end portion 116 of the blade 98 causes the end portion 116 to break away from the upper portion 114 along the break line 118.

Figure 13:
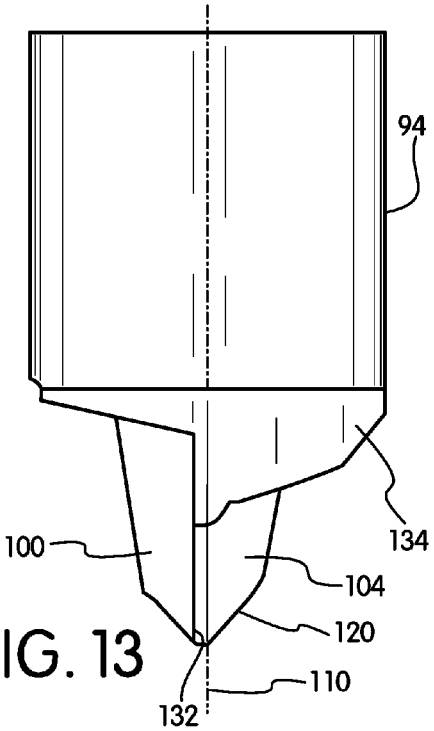
FIG. 13 is a rear view of the screw ground anchor with the tip section separated.
Figure 14:
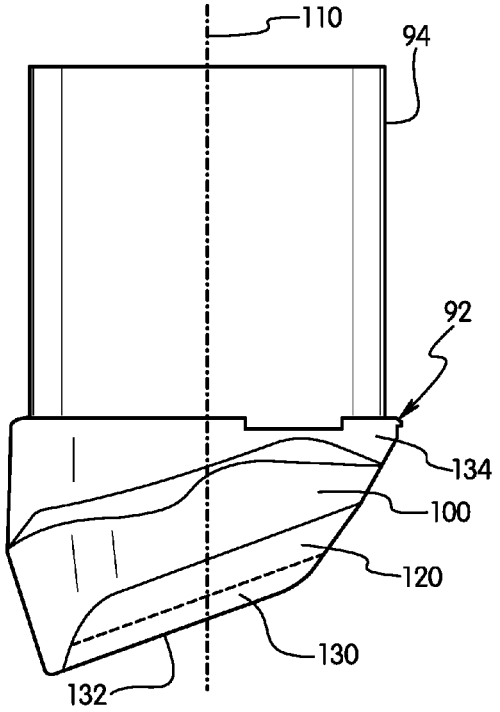
FIG. 14 is a side view of the screw ground anchor with the tip section separated.
Figure 15:
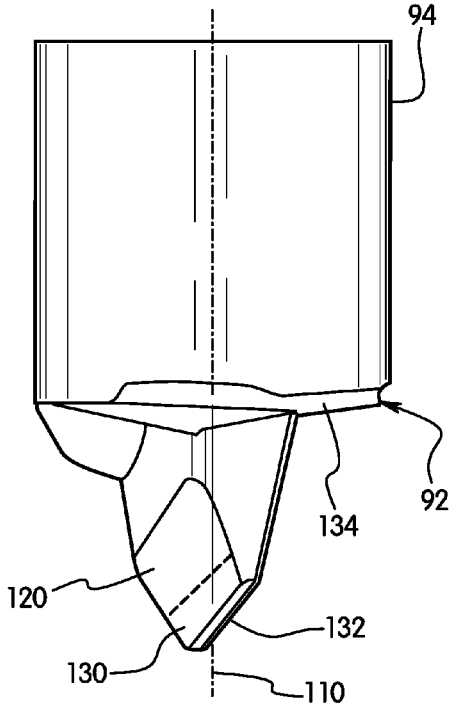
FIG. 15 is a front view of the screw ground anchor with the tip section removed.
Figure 16:
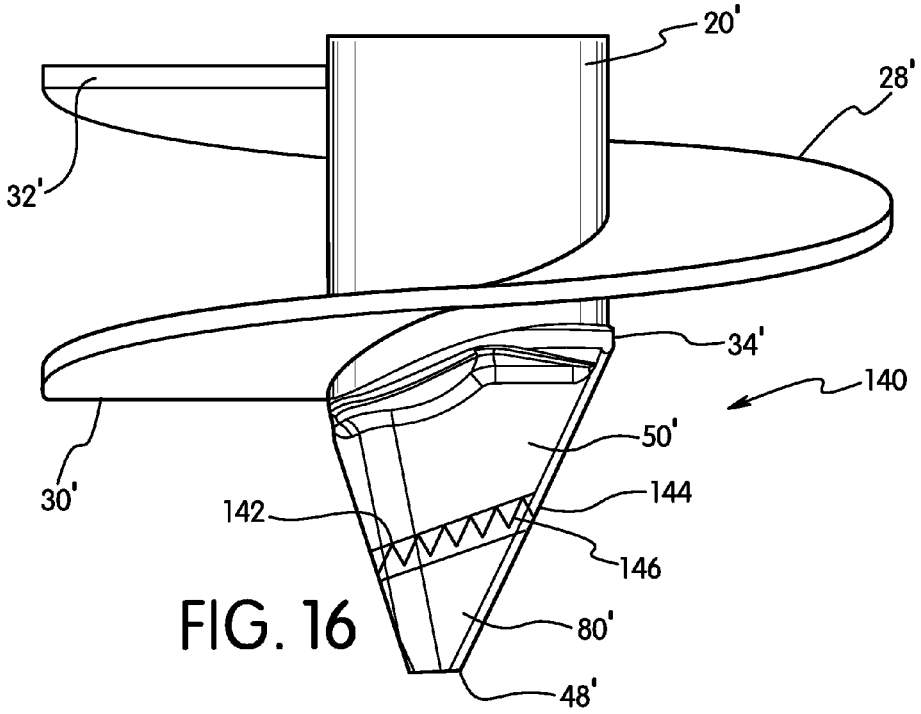
FIG. 16 is a side view of the screw ground anchor in a second embodiment of the invention.
Figure 17:
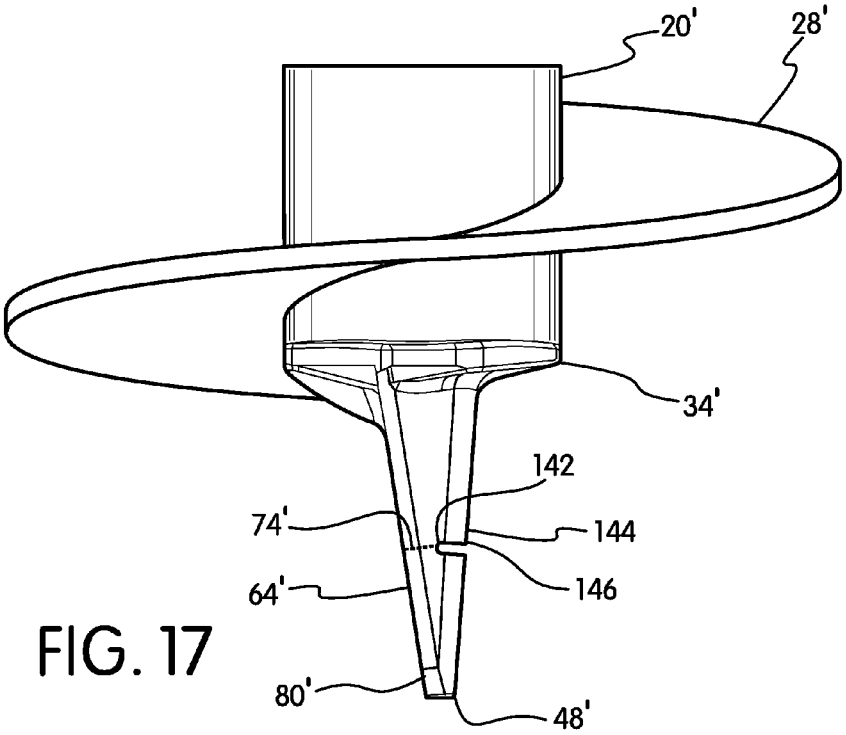
FIG. 17 is a front view of the screw ground anchor of FIG. 16.

In the embodiment shown, the break line 118 typically extends substantially in the plane of the first upper face 120 to the inner edge of the first upper face 126 of the second groove 124 as shown in FIGS. 13-15. The breakable end portion 116 breaks free from the upper portion 114 to form a broken face 130 extending between the upper face 120 of the first groove 112 and the second lower face 128 of the second groove 124 as shown in FIGS. 14 and 15. In this embodiment, the broken face 130 is substantially aligned with the upper face 120. The upper face 126 of the second groove becomes the ground engaging surface for penetrating denser soil and rock that cannot be effectively penetrated by the axial end 118 of the blade 98. The first upper face 126 of the second groove has a longitudinal dimension and surface area greater than the longitudinal dimension and surface area of the axial end 108 for effectively penetrating dense soil and rock. The resulting cutting end of the anchor is formed by the faces 130 and 120 and the second major face 102 converging toward the face 126 which now forms the ground engaging axial face.

As shown in FIG. 13, the first upper face 126 forming the cutting edge of the ground anchor 90 has an innermost edge 132 aligned with the longitudinal center axis 110 and the longitudinal ends at the respective first and second minor faces 104 and 106 spaced radially outward from the longitudinal center axis 110. The longitudinal end of the upper face 126 at the first minor face 104 is spaced radially inward from the body portion 134 and spaced outwardly from the longitudinal center axis 110 a first distance and the longitudinal end of the upper face 126 at the second minor face 106 is spaced from the longitudinal center axis 110 a second distance greater than the first distance. As shown in FIG. 14, the longitudinal end of the face 126 at the second minor face 106 forms a pointed end of the ground engaging end of the blade 98 that revolves in a circular path around the longitudinal center axis 110. The face 126 forming the cutting edge of the blade 98 is formed at an incline with respect to the longitudinal axis 110 compared to the axial end 108 forming a face lying in a plane substantially perpendicular to the longitudinal axis 110. The face 126 forms a ground engaging axial face having a surface area that is greater than the surface area of the axial end 108 formed by the breakable end portion 116.

Another embodiment shown in FIGS. 16-19 are similar to the embodiment of FIGS. 3-5 so that the same parts and components are identified by the same reference number with the addition of a prime. In the embodiment of FIGS. 16-19, the ground anchor 140 includes a ground engaging lead 18', a hub 20' and a helical screw 28' as in the embodiment of FIGS. 3-5. A blade 46' having an axial end 48' extends from a body portion 34'. The blade 46' has a first major face 50' and an opposing second major face 52' with a first minor face 54' and a second minor face 56' extending between the first and second major faces 50' and 52'. The groove 68' is formed in the first major face 50' in a manner similar to the previous embodiment.

Figure 18:
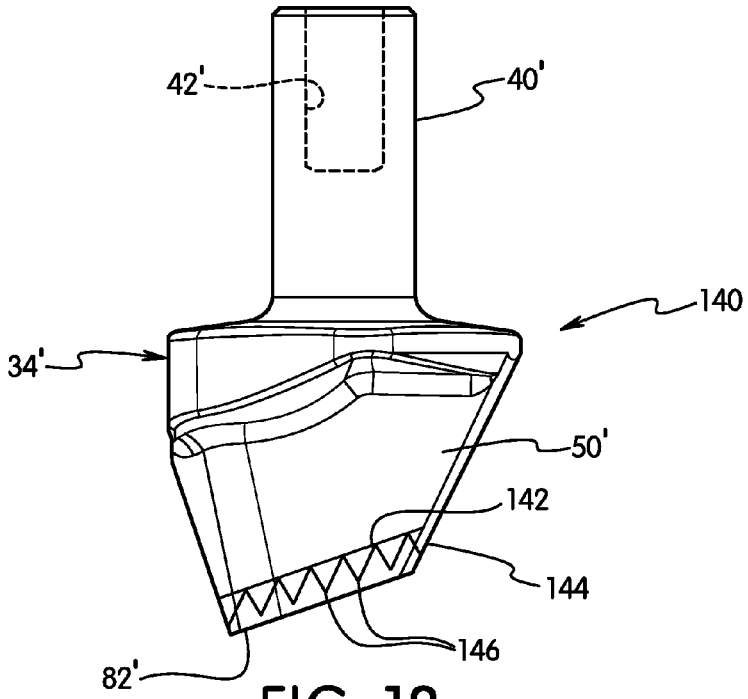
FIG. 18 is a side view of the screw ground anchor of FIG. 16 with the tip section removed.
Figure 19:
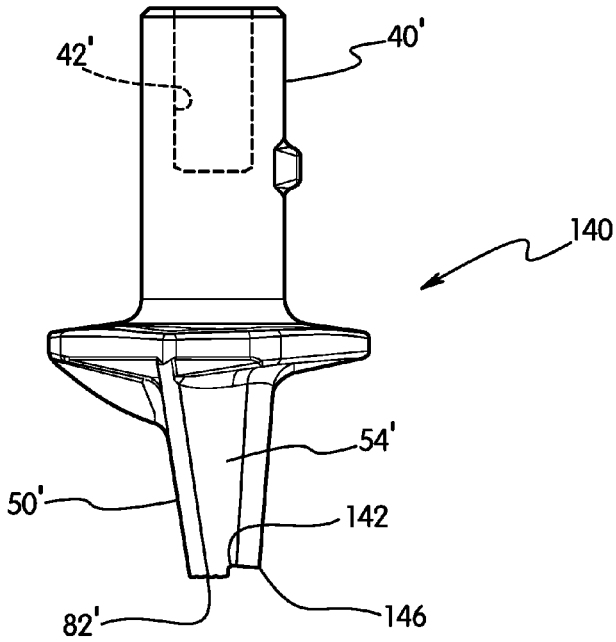
FIG. 19 is a front view of the screw ground anchor of FIG. 18.

The upper edge 142 of the groove 68' is formed with a serrated edge to define a plurality of teeth 146. As in the previous embodiment, the groove 68' defines a break line 74' extending diagonally across the blade 46'. As the ground anchor 140 is driven into the ground, the stress and torque applied to the end portion 80' of the blade 46' breaks along the break line 74' to expose the teeth 146. As shown in FIG. 18, the break line 74' forms the ground engaging cutting edge with the teeth 146 extending diagonally with respect to the longitudinal axis of the ground anchor.

While various embodiments have been chosen to illustrate the invention, it will be understood by those skilled in the art that various changes and modifications can be made without departing from the spirit and scope of the invention as defined in the appended claims.

What is claimed is:

1. A ground anchor comprising:

a shaft adapted for coupling to a drive assembly to rotate said ground anchor;

a body portion integrally formed with said shaft, said body having a dimension greater than said shaft, said body having a top side coupled to said shaft and a ground engaging bottom side; and a blade projecting downwardly from said bottom side of said body portion, said blade having a top end portion attached to said body portion, first and second major faces converging to an axial face at a distal end of said blade to form a first cutting edge, and first and second minor faces extending between said major faces and converging toward said axial face at said blade having a frangible portion forming a break line across the major faces for breaking a bottom end portion of said blade from said top end portion of said blade to form a second cutting edge on said blade.

2. The ground anchor of claim 1, further comprising a hub coupled to said top side of said body portion, said hub having an axial opening for coupling with a rotatable drive member for driving said ground anchor into the ground, and a helical load bearing member extending outwardly from said hub.

3. The ground anchor of claim 1, wherein said distal end of said blade has a first blunt axial end face with a first dimension; and said broken end portion exposing a second blunt axial end face of said blade having a dimension greater than said first dimension.

4. The ground anchor of claim 1, wherein
said frangible portion is defined by a first transverse groove in said first major face.

5. The ground anchor of claim 4, wherein
said first transverse groove extends at an incline with respect to a longitudinal axis of said blade, said first transverse groove forming said second blunt axial end face at an incline with respect to the longitudinal axis of said blade.

6. The ground anchor of claim 5, wherein
said first transverse groove has a serrated edge whereby said second blunt axial end face has a serrated ground engaging edge.

7. The ground anchor of claim 5, further comprising
a second groove formed in said second major face and extending substantially parallel to said first groove.

8. The ground anchor of claim 7, wherein
said first groove has an inclined face extending at an incline with respect to the longitudinal axis of said blade; and
said second groove has an inclined face extending at an incline with respect to the longitudinal axis, said inclined face of said first groove being substantially aligned with said inclined face of said second groove to define a break line therebetween.

9. The ground anchor of claim 7, wherein
said first groove has an inclined face extending from said first major surface toward said second major surface, and
said second groove has an inner face lying in a plane substantially perpendicular to said longitudinal axis of said tip,
wherein said second blunt axial face is defined by said inclined face of said first groove and said inner face of said second groove.

10. A ground anchor adapted for driving into the ground, said ground anchor comprising:
a hub having a radially extending, helical load bearing member, said load bearing member extending outward from said hub and having a leading edge and a trailing edge;
a body portion having a top side coupled to a bottom end of said hub and a bottom side facing away from said hub in an axial direction with respect to said hub; and
a blade projecting axially downward from said bottom side of said body portion, said blade having first and second major faces and first and second minor faces extending between said major faces, each of said major and minor faces converging to a distal end having a first axial face, said blade having a frangible portion extending between said first major face and second major face to break an end portion from said blade to expose a ground engaging second axial face of said blade having a dimension and surface area greater than said first axial face.

11. The ground anchor of claim 10, wherein
said first axial face lies in a plane substantially perpendicular to a longitudinal axis of said ground anchor.

12. The ground anchor of claim 11, wherein
said second axial face lies in a plane extending at an incline with respect to the longitudinal axis of said ground anchor.

13. The ground anchor of claim 10, wherein
said frangible portion is defined by a first transverse groove in said first major face.

14. The ground anchor of claim 13, wherein
said first transverse groove extends diagonally with respect to said longitudinal axis of said ground anchor.

15. The ground anchor of claim 14, wherein
said first transverse groove has a serrated edge.

16. The ground anchor of claim 14, further comprising
a second groove on said second major face and aligned with said first groove.

17. The ground anchor of claim 16, wherein
said first groove has a first face with a longitudinal dimension extending at an incline diagonally across said first major face with respect to the longitudinal axis of said blade of said ground anchor, and
said second groove has a first face extending at an incline diagonally across said first major face with respect to the longitudinal axis of said blade of said ground anchor.

18. The ground anchor of claim 17, wherein
said first face of said first groove has a transverse dimension lying in a plane substantially perpendicular to said longitudinal axis of said blade, and has a second face intersecting with said first face whereby said first groove has a substantially V-shape; and
said first face of said second groove has a transverse dimension lying in a plane substantially perpendicular to said longitudinal axis of said blade, and has a second face intersecting with said first face, whereby said second groove has a substantially V-shape.

19. A method of anchoring a structure to the ground, said method comprising:
driving a ground anchor into the ground to a first depth, said ground anchor having a hub with a radially extending helical load bearing member, said load bearing member extending outward from said hub and having a leading edge and trailing edge;
a body portion having a top side coupled to a bottom end of said hub and an axially facing bottom side facing away from said hub, and a blade projecting from said bottom side of said body portion, said blade having first and second major faces and first and second minor faces extending between said major faces, each said major and minor faces converging to a distal end having a substantially blunt axial face with a first dimension;
said method further comprising driving said ground anchor into the ground to a second depth whereby a breakable end portion of said blade breaks free of said tip to expose a second blunt axial face having a second dimension greater than said first dimension without removing the ground anchor or broken end portion from the ground; and
coupling the structure to the ground anchor.

20. The method of claim 19, wherein
said blade has a frangible portion to define said breakable end portion.

21. The method of claim 20, wherein
said frangible portion is defined by a first groove formed on said first major face and a second groove formed on said second major face and extend parallel to said first groove.

22. The method of claim 21, wherein
said first groove and second groove have a longitudinal dimension extending diagonally with respect to an axial dimension of said ground anchor.

23. The ground anchor of claim 1, wherein
said frangible portion extends between said first major face and said second major face.

24. The ground anchor of claim 1, wherein
said break line extending diagonally with respect to a longitudinal axis of said blade.

25. The ground anchor of claim 1, wherein
said first cutting edge is formed in a plane substantially perpendicular to a longitudinal axis of said blade, and said second cutting edge is formed in a plane extending at an incline with respect to said longitudinal axis.

26. The ground anchor of claim 1, wherein said frangible portion is formed in said first major face.

* * * * *